United States Patent [19]

Siefert et al.

[11] 4,004,408

[45] Jan. 25, 1977

[54] MECHANICAL IMPROVEMENT ON AN ELECTRIC ALARM CLOCK

[75] Inventors: Roland Siefert, Bad Durrheim; Hans Seckinger; Herbert Krösche, both of Schwenningen, all of Germany

[73] Assignee: Kienzle Uhrenfabriken GmbH, Schwenningen, Germany

[22] Filed: Mar. 29, 1974

[21] Appl. No.: 456,250

[30] Foreign Application Priority Data

Apr. 3, 1973 Germany ..... 7312472[U]
Apr. 6, 1973 Germany ..... 7313007[U]

[52] U.S. Cl. ..... 58/38 R; 58/33; 58/152 B; 200/37 R

[51] Int. Cl.[2] ..... G04C 13/06; G04C 21/00; G04B 37/12; H01H 7/08

[58] Field of Search ..... 58/19 A, 19 R, 21.15, 58/21.155, 33, 38, 39.5, 50 R, 57.5, 85.5, 152 R, 152 B; 200/37 R, 37 A

[56] References Cited

UNITED STATES PATENTS

| | | | |
|---|---|---|---|
| 3,018,340 | 1/1962 | Eggert et al. | 200/37 R |
| 3,081,594 | 3/1963 | Atkins et al. | 58/38 X |
| 3,361,973 | 1/1968 | Wyseng | 58/33 X |
| 3,386,238 | 6/1968 | Voit | 58/21.15 X |
| 3,577,725 | 5/1971 | Ganter | 58/38 |
| 3,643,418 | 2/1972 | Palin et al. | 58/85.5 X |
| 3,643,421 | 2/1972 | Herr et al. | 58/50 R |
| 3,689,919 | 9/1972 | Ganter et al. | 58/38 A |
| 3,824,782 | 7/1974 | Iinuma | 58/57.5 |

*Primary Examiner*—E. S. Jackmon
*Attorney, Agent, or Firm*—Pugh & Keaty

[57] ABSTRACT

There is provided an alarm clock of the type which produces an electric signal and which operates in conjunction with an auxiliary device. The clock comprises first circuit means having first switch means for producing and cancelling the signal, and second circuit means having second switch means for switching the auxiliary device on and off. A single spring contact forms a common switch member of said first and second switch means. The advantage gained hereby is that the number of switches normally required to produce and cancel said signal and to energize and de-energize said auxiliary device is reduced.

6 Claims, 4 Drawing Figures

MECHANICAL IMPROVEMENT ON AN ELECTRIC ALARM CLOCK

BACKGROUND OF THE INVENTION

The present invention relates generally to improvements in electric alarm clocks, and in particular to an improved tripping and cancelling mechanism for alarm clocks which produce electrical signals. The invention also relates to an associated switch for switching on and off an auxiliary device, such as a lamp, which can be incorporated into or attached to the clock.

In the case of alarm clocks which produce an electrical signal, it is normal practice to control the production of the signal by means of two switches which are arranged in series and close the signal generating circuit.

The first switch is operated by hand and, when closed, serves to set the alarm mechanism in readiness for the production of the signal. The signal can be cancelled by opening this switch.

The second switch is coupled to the hour wheel or alarm tripping wheel of the clock. It closes when the preset alarm time is reached, whereupon a dog carried by the hour wheel may drop into a recess in the alarm tripping wheel.

Thus, the circuit is arranged so that a signal is only produced when both the switches are closed.

In addition a third switch is provided for illuminating the bezel of the face of the clock when desired or to enable an auxiliary device such as a reading light to be switched on.

Because these switches are elaborate in design and liable to breakdown, and because a relatively large number of working steps and soldering operations are required to incorporate them in the clock it is desirable to reduce the number of switches required.

Accordingly, the present invention comprises an alarm clock which produces an electric signal and which operates in conjunction with an electric auxiliary device, wherein the circuit required to produce said signal and the circuit required to energize said auxiliary device are closed and opened by means of a single electrical contacting spring.

Thus, a single spring will suffice for all the three aforementioned switching functions (tripping the alarm, manually cancelling the alarm, switching the light on and off).

BRIEF DESCRIPTION OF THE DRAWINGS

S;o that the invention will be more readily understood and further features thereof made apparent, an alarm clock according to the invention will now be described with reference to the accompanying drawing, in which.

DESCRIPTION OF THE PREFERRED EMBODIMENT

Thus, the illustrated alarm signal tripping and cancelling mechanism comprises a tripping lever having a first arm 1, a vertically movable elongate member or center section 2 and second and third arms 3 and 4, and a control element or cancel button 10 which operates in conjunction with the arm 1.

Figure 1A:
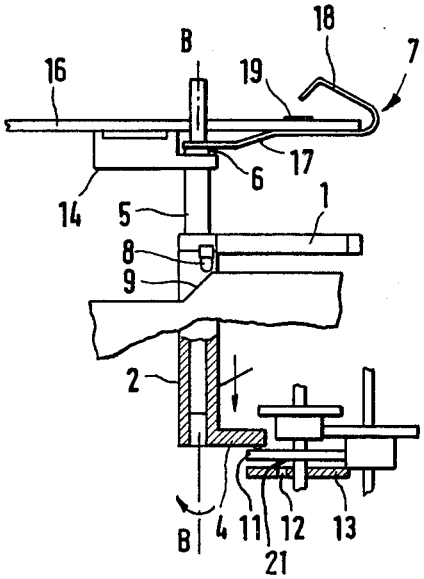
FIG. 1*a* shows in partial section an alarm signal tripping and cancelling mechanism for use with an alarm clock according to the invention; the mechanism as seen in this Figure is not in readiness to produce an alarm signal.
Figure 2A:
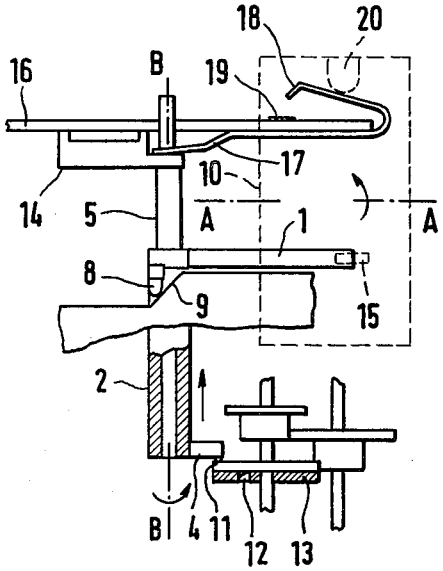
FIG. 2*a* shows the mechanism of FIG. 1*a* in partial section and in readiness to produce an alarm signal.
Figure 2B:
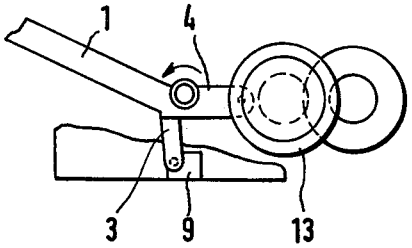
FIG. 2*b* is a bottom plan view of the mechanism shown in FIG. 2*a*.

For the sake of clarity, the arm 1 has been shown offset through 180° in FIGS. 2*a* and 2*b*, in relation to the position occupied by the arm in FIGS. 1*a* and 2*b*.

The control element or cancel button 10 is capable of being pivoted about an axis A—A, and can be arranged at the top of the clock case. The button has provided theron an inclined surface 15 which is arranged to cooperate with said first arm 1 of the tripping lever in a manner such that when the button is pressed the lever is pivoted about an axis B—B.

The first arm 1, the center section 2 and the second and third arms 3 and 4, of the tripping lever, may conveniently be made in one piece, for example from a synthetic resin material. Screwed into the centre section 2 is an adjusting member 5 having arranged thereon a surface or shoulder 6 against which one end of an electrical contacting spring 7 abuts. The spring 7 is arranged to operate in conjunction with a circuit member such as a printed circuit board 16, to which the spring may be attached by lugs or other suitable means, as by soldering. At that side of the printed circuit board 16 facing the works of the clock, the spring has a bent portion 17 which together with a first electrical contact 14 forms a switch for tripping the alarm. This spring portion 17 bears against the shoulder 6 on the tripping lever.

As will be seen from the drawing, the arm 4 is arranged to operate in conjunction with an hour wheel 11 having a stud 21 located thereon which in operation of the mechanism engages a recess 12 in an alarm tripping wheel 13 when a present alarm time is reached.

As previously mentioned FIG. 1*a* shows the position of the components of the alarm tripping and cancelling mechanism when said mechanism is not in readiness to produce a signal. In this position a dog 8 located on the second arm 3 bears against the top part of the inclined surface 9 which may be fixed to the plate supporting the works of the clock or to the clock housing. In this position of the dog 8, the stud 21 on the hour wheel 11 is not in engagement in the recess 12 in the alarm tripping wheel 13. The arm 4 of the tripping lever bears against the hour wheel 11. The spring element 17 is forced off the contact strip 14. The circuit producing the electrical signal, is therefore open. When the button (which is on the far side of the arm 1 when viewed from the perspective of FIG. 2*a*) is pressed on the side of the element 15, the arm 1 is pivoted upwards, perpendicularly to the plane of the drawing to occupy the same angular position as that shown in FIG. 2, whereby the dog 8 is lifted away from the inclined surface 9. The alarm mechanism is now in a state of readiness. The spring element 17 initially remains out of contact with the strip 14.

This condition is maintained until the preset alarm time is reached, whereupon the hour wheel 11 is urged against the alarm tripping wheel 13 and the stud 21 on the hour wheel 11 drops into the recess 12 in the alarm tripping wheel 13, under the force exerted by the spring 17, (FIG. 2).

The whole tripping lever assembly then moves downwards, as seen in the drawing, so that the spring element 17 bears against the contact strip 14 and thus closes the switch producing the alarm signal.

Figure 1B:
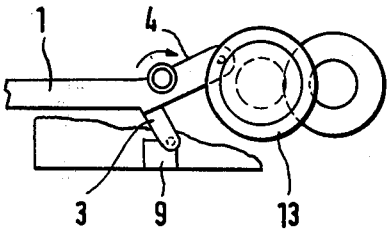
FIG. 1*b* is a bottom plan view of the mechanism shown in FIG. 1*a*.

To cancel the signal, the arm 1 of the tripping lever is pivoted back to the angular position parallel to the top of the clock case occupied by said arm in FIG. 1, by pressing the button 10 at the top of the clock case. The button 10 contacts the arm at point 15 because the dog 8 must slide over the inclined surface 9 as the arm 1 is returned this pivoting motion is accompanied by axial displacement of the tripping lever in an upward direction, as seen in the drawing. As the tripping lever moves upwards the spring 17 is forced upwards and is lifted away from the contact strip 14; the signal is thus silenced.

If the signal is not cancelled manually in the manner described, then the stud 21 on the hour wheel 11, is automatically lifted out of the recess 12 as the hour wheel continues to rotate. The stud 21 is assisted in this latter movement by an inclined surface which may be located in the recess 12 and/or on the stud 21. The hour wheel 11 is lifted away from the alarm tripping wheel 13 and forces the tripping lever axially upwards via the arm 4, so that the spring 17 is again raised and the signal cancelled.

The correct time of operation of that part of the signal switch formed by spring 7 and contact strip 14, can be adjusted by screwing the pivot element 5 into the center section 2 of the tripping lever, to a greater or lesser extent. In accordance with the invention provision is also made for a switch which enables an auxiliary device to be energized and de-energized.

As will be seen from the drawing the spring 17 is curved around the printed circuit board or circuit member 16 and at the rear thereof has a bent portion 18. The bent portion 18 together with a second electrical contact 19, which may be part of the circuit member 16, forms a switch for an auxiliary device, such as a lamp.

This latter switch is operated by moving the button 10 to its second position, in which a projection or nose 20 on the switch forces the bent spring portion 18 into contact with the second electrical contact 19. This closes the light circuit. The spring element 7 serves at the same time to return the button from its second to its first position.

Although the invention has been described and illustrated with reference to an embodiment thereof, this embodiment is not restrictive, but can be modified within the scope of the following claims.

What is claimed as invention is -

1. An alarm clock which produces an electric alarm signal and which operates in conjunction with an electric auxiliary device comprising:

first circuit means having first switch means for producing and cancelling said signal, said first switch means including a first switch member;

second circuit means having second switch means of energizing and de-energizing the auxiliary device;

a single electrical contact spring forming an integral part of said two circuit means; and a circuit board having a circuit member thereon; said contact spring having a central part thereof permanently fixed to said circuit board;

a first end arranged for movement into and out of circuit making contact with said first switch member; and a second end arranged for movement into and out of circuit making contact with said circuit member.

2. The alarm clock of claim 1 wherein there is further included:

an elongated, longitudinally movable and rotatable member;

a seating surface for said first end of said contact spring located on said elongated member for movement therewith; and longitudinally moving means for longitudinally moving said elongated member between a signal producing and a signal cancelling position; said first switch member being located in the path of movement of said contact spring end seating surface, and said first spring end exerting a spring force which acts in the longitudinal direction of said elongated member.

3. The alarm clock of claim 2 wherein there is further included:

actuating means for rotating said elongated member about its longitudinal axis between a signal inactivated position and a signal activated position;

a first arm fixed to said elongated member; and first operating means located on said actuating means and co-acting with said first arm to effect rotation of said elongated member about its longitudinal axis between said signal inactivated and signal activated positions.

4. The alarm clock of claim 3 wherein there is further included:

second and third arms located on said elongated member;

first cam means mounted on said second arm;

second cam means stationarily arranged on said clock and co-acting with said first cam means to return said elongated member to and to hold it in said signal inactivated position; and co-acting means co-acting with said third arm to permit longitudinal movement of said elongate member between said signal producing and said signal cancelling positions under the force of said first spring end.

5. The alarm clock of claim 3 wherein said actuator means further includes:

second operating means for moving said second end of said contact spring into engagement with said circuit member to energize said auxiliary device.

6. The alarm clock of claim 4 wherein said elongated member comprises two sections which can be adjusted axially in relation to each other.

* * * * *